US010222059B2

(12) United States Patent
Wallace et al.

(10) Patent No.: US 10,222,059 B2
(45) Date of Patent: Mar. 5, 2019

(54) APPARATUS FOR REDUCING EMISSIONS WHEN BURNING VARIOUS FUELS

(71) Applicants: Daniel Patrick Wallace, Bethel, CT (US); Charles A. White, III, Danbury, CT (US); Joseph R. Wallace, Bethel, CT (US); Howard E. Wells, IV, Dover, DE (US); Darrel Scribner, East Haven, CT (US); Peter P. Cantatore, Trumbull, CT (US); Jianhui Hong, Buffalo Grove, IL (US)

(72) Inventors: Daniel Patrick Wallace, Bethel, CT (US); Charles A. White, III, Danbury, CT (US); Joseph R. Wallace, Bethel, CT (US); Howard E. Wells, IV, Dover, DE (US); Darrel Scribner, East Haven, CT (US); Peter P. Cantatore, Trumbull, CT (US); Jianhui Hong, Buffalo Grove, IL (US)

(73) Assignee: Preferred Utilities Manufacturing Corporation, Danbury, CT (US)

( * ) Notice: Subject to any disclaimer, the term of this patent is extended or adjusted under 35 U.S.C. 154(b) by 194 days.

(21) Appl. No.: 15/238,465

(22) Filed: Aug. 16, 2016

(65) Prior Publication Data

US 2018/0051875 A1 Feb. 22, 2018

(51) Int. Cl.

| | |
|---|---|
| ***F23D 14/70*** | (2006.01) |
| ***F23C 9/00*** | (2006.01) |
| ***F23D 14/22*** | (2006.01) |

(52) U.S. Cl.

CPC ..... *F23D 14/70* (2013.01); *F23C 9/00* (2013.01); *F23D 14/22* (2013.01); *F23C 2202/40* (2013.01)

(58) Field of Classification Search

CPC ..... F23D 14/02; F23D 14/70
USPC ..... 431/1
See application file for complete search history.

(56) References Cited

U.S. PATENT DOCUMENTS

| | | | | |
|---|---|---|---|---|
| 5,636,977 | A * | 6/1997 | Benson | F23C 6/047 431/115 |
| 5,791,892 | A * | 8/1998 | Dobbeling | F23D 14/02 431/175 |
| 6,502,399 | B2 * | 1/2003 | Mandai | F23R 3/14 60/747 |
| 2001/0046649 | A1 * | 11/2001 | Schutz | F23C 6/047 431/4 |
| 2002/0092482 | A1 * | 7/2002 | Bodnar | F23D 14/02 122/15.1 |

(Continued)

*Primary Examiner* — Steven B McAllister
*Assistant Examiner* — Allen Schult
(74) *Attorney, Agent, or Firm* — Jianhui Hong

(57) ABSTRACT

An apparatus for burning of a gaseous fuel includes a gas manifold comprising a blast tube with an axis of rotation and an outer wall; a center bluff body disposed inside the blast tube; a plurality of aerodynamic blocks circumferentially distributed in the annular space between the blast tube and the center bluff body, creating passage channels for combustion air between the aerodynamic blocks; two injector nozzles located inside the wake zone of each of the aerodynamic block and are fluidically communicating to the gas manifold; an air control mechanism comprising a center hub and a plurality of air control modules. The control modules fit through the passage channels. Each air control module comprises an air deflector located at the outer edge of a passage channel.

7 Claims, 11 Drawing Sheets

SECTION A-A

(56) References Cited

U.S. PATENT DOCUMENTS

2006/0218818 A1* 10/2006 Christopher ..... B60S 3/002
34/666

* cited by examiner

SECTION A-A

SECTION B-B

SECTION C-C

APPARATUS FOR REDUCING EMISSIONS WHEN BURNING VARIOUS FUELS

BACKGROUND OF THE INVENTION

1. Field of the Invention

This invention relates generally to combustion apparatus, and more specifically relates to a burner that is capable of achieving high turndown, high thermal efficiency, and extremely low NOx, CO and hydrocarbon emissions.

2. Description of the Related Art

Boilers are widely used for the generation of hot water and steam. A conventional boiler (excluding Heat Recovery Steam Generator or HRSG) comprises a furnace in which fuel is burned, and surfaces typically in the form of steel tubes to transfer heat from the flue gas to the water. A conventional boiler has a furnace that burns a fossil fuel or, in some installations, waste fuels or biomass derived fuels. Most conventional boilers are classified as either firetube or watertube types. In a firetube boiler, the water surrounds the steel tubes through which hot flue gases from the furnace flow. In a watertube boiler, the water is inside the tubes with the hot flue gases circulating outside the tubes. The current invention can be used in firetube and watertube boilers, as well as in other applications including but not limited to furnaces, incinerators and ovens. NOx is a recognized air pollutant. Regulations on NOx tend to get more stringent in densely populated areas of the world. In some areas, local regulations require low NOx or even ultra low NOx emissions in the exhaust from the combustion processes. Various low NOx and ultra low NOx burners are available in the market to meet these requirements. A review of typical NOx reduction methods can be found in the article "NOx emissions: Reduction Strategy" in "Today's Boiler" magazine Spring 2015 by Jianhui Hong. FGR (Flue gas recirculation) is a commonly used technique for NOx reduction. In one common implementation called "Induced FGR", flue gas is drawn through a pipe or duct to the inlet of a blower and mixed with the combustion air by using the blower wheel as a mixing device.

According to the Perry's Chemical Engineers' Handbook ($7^{th}$ Edition) Section 10-46, the horsepower requirement for a centrifugal blower is determined by the multiplication of two factors, the volumetric flow rate through the blower in cubic feet per minute, and the blower operating pressure in inches water column. Induced FGR increases both the volumetric flow rate through the blower and the pressure drop through the burner and the boiler (hence increasing the blower operating pressure), and therefore greatly increases the horsepower requirement for the blower motor. Everything else being equal, if the amount of induced flue gas is reduced, the horsepower requirement of the motor can be reduced as well.

U.S. Pat. No. 5,407,347A teaches an apparatus and method for reducing NOx, CO and hydrocarbon emissions when burning gaseous fuels. The advantage of this invention is that ultra low NOx emission can be achieved at relatively low oxygen level (such as 3% dry volume basis) in the flue gas. The shortcoming of this technology is that a large amount of FGR (up to 40% of combustion air by mass) is required to achieve <9 ppm NOx emissions. In addition, the rapid mixing design requires large pressure drops across the swirl vanes in the combustion air pathway near the burner head. Since mixing rate slows down as flow velocity is reduced, this design also has a limited turndown (3:1 or 4:1 in some cases) for ultra low NOx performance. Due to the large amount of FGR and the high pressure drop the air/FGR mixture has to overcome, a markedly larger motor and a larger blower are required compared to a typical burner of the same firing rate. The larger motor means higher initial capital costs, higher electricity consumption and higher noise during the burner's operation. In the state of California in particular, operators of boilers often dislike use of FGR, perhaps due to the concerns of earthquake and the additional mandatory structural inspection related to the field installation of the FGR pipe. U.S. Pat. No. 6,776,609 also discussed the motor size penalty problem in details related to the use of Induced FGR for ultra low NOx performance.

Another commonly used technique for ultra low NOx is called "lean premixed combustion". U.S. Pat. No. 6,776,609 was intended to teach a method for operating a burner with FGR, but it also discussed the disadvantages of the lean premixed combustion method based on fiber matrix. It disclosed that "Alzeta Corp. of Santa Clara, Calif. sells a burner for use in food processing and other industries that utilizes only excess combustion air (no FGR) to achieve the flame dilution necessary for 9-ppm NOx emissions. A dilution level of 60% on a mass basis is required". The shortcomings of the "lean premixed combustion" technique are well recognized in the combustion community: low thermal efficiency due to the very high excess air level and the resultant very high oxygen level in the flue gas (9% oxygen is typical), and the extra electricity consumption due to the extra excess air for the dilution effects. The large amount of excess air was intended to reduce the peak flame temperature by dilution effects. The extra dilution air carries additional heat into the atmosphere (wasted heat) when the exhaust is vented, and causes a reduction of thermal efficiency.

In view of the foregoing, there exists a need for an improved method and apparatus for burning a gaseous fuel that can achieve high turndown, extremely low emissions of NOx, CO and hydrocarbons, low electricity consumption for the motor, and high thermal efficiency (low excess oxygen in the flue gas) at the same time.

SUMMARY OF THE INVENTION

It is a general object of the present invention to provide an apparatus for burning of a gaseous fuel and producing extremely low emissions of NOx, CO and hydrocarbons in the burning process.

A more specific object of the present invention is to provide an apparatus for burning of a gaseous fuel that achieves high turndown, ultra low NOx emissions, low oxygen level in the flue gas which leads to higher thermal efficiency, low horsepower requirement for the blower motor for the burner.

These objects are achieved by an apparatus for burning of a gaseous fuel, said apparatus comprising a gas manifold 10 comprising an inlet pipe 11, a blast tube 13 and an outer wall 12, wherein said blast tube 13 is substantially cylindrical with an inside diameter D and an axis of rotation AoR; a center bluff body 40 with an outside diameter d such that the ratio d/D is in the range of 0.45 to 0.65; a plurality of aerodynamic blocks 20 circumferentially distributed in the annular space between said blast tube 13 and said center bluff body 40, creating passage channels 70 for combustion air between said aerodynamic blocks 20, said aerodynamic blocks 20 are affixed to the inside of said blast tube 13; each of said aerodynamic block comprising a small and substantially closed leading end 21 and a large and open trailing end 22, forming a wake zone 29 inside and downstream of said aerodynamic block; Two injector nozzles 60 located inside wake zone 29 of each of said aerodynamic block; said nozzles 60 are fluidically communicating with said gas manifold 10; An air control mechanism 30 comprising a center hub 31 and a plurality of air control modules 33, said air control modules 33 fitting through said passage channels 70, wherein each air control module comprising an air deflector 35 located at the outer edge of each of said passage channels 70, said deflector forming an angle theta equal to or greater than 30 degrees from said axis of rotation.

Additional objects and features of the invention will appear from the following description from which the preferred embodiments are set forth in detail in conjunction with the accompanying drawings.

BRIEF DESCRIPTION OF THE DRAWINGS

Identical reference numerals throughout the figures identify common elements.

DESCRIPTION OF THE PREFERRED EMBODIMENTS

For the purpose of this disclosure, the phrase "combustion air" may be air from the atmosphere supplied through the burner for combustion of the fuel, or may be the mixture of air and flue gas when the technique of FGR is used.

Figure 1:
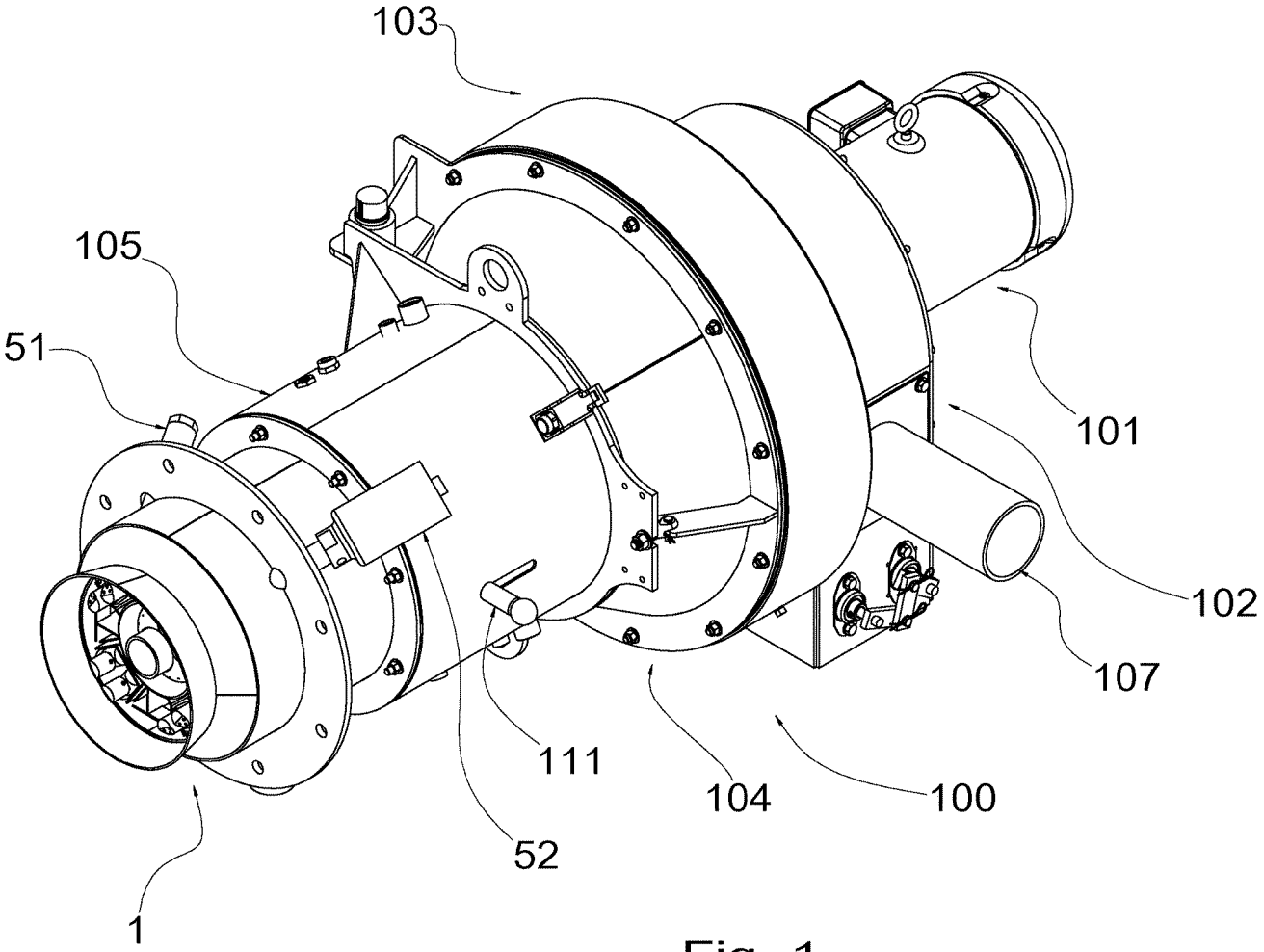
FIG. 1 is a trimetric view of an embodiment of the apparatus in accordance with the present invention.
Figure 2B:
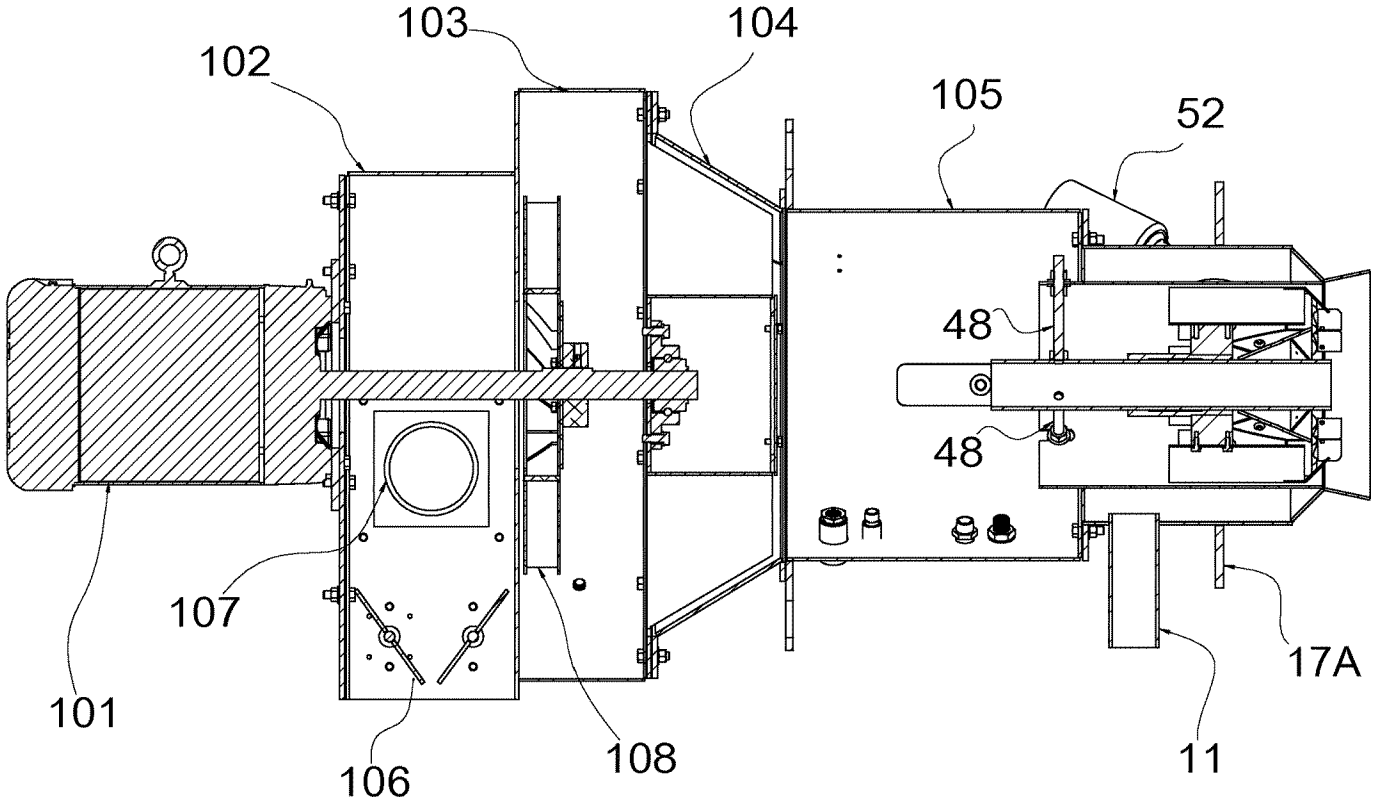
FIG. 2B shows a section view of the apparatus in FIG. 2A along section line A-A.
Figure 2A:
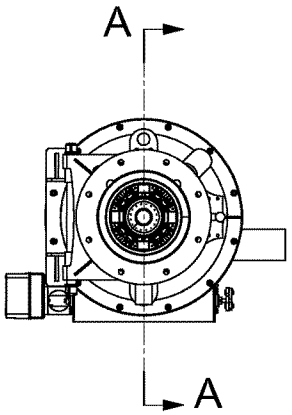
FIG. 2A shows a front view of the apparatus in FIG. 1.

FIG. 1 shows a trimetric view of an embodiment of the apparatus in accordance with the present invention. FIG. 2A shows a front view of the burner in FIG. 1. FIG. 2B shows a sectional view of the apparatus in FIG. 2A, taken along line A-A. The apparatus in FIGS. 1 and 2 is typically referred to as a burner. The burner comprises a burner head 1 and a burner body 100. The burner body 100 comprises an electric motor 101 (internal details not shown), a louver box 102, a blower housing 103, a transition duct 104, an air duct 105. The louver box 102 includes two air dampers 106 and an inlet pipe 107 for recirculated flue gas. A blower wheel 108 is located inside the blower housing 103, and is driven by the electric motor 101. The blower wheel 108 serves to provide the combustion air for the burner, and also serves to induce FGR (flue gas recirculation) through the inlet pipe 107. The air dampers 106 and optionally a variable frequency drive (VFD, not shown) are used to precisely control the amount of combustion air for the proper combustion of the fuel. As is well known in the art, an FGR damper (not shown) is often used to control the ratio of the recirculated flue gas to the air from the ambient atmosphere.

Figure 4:
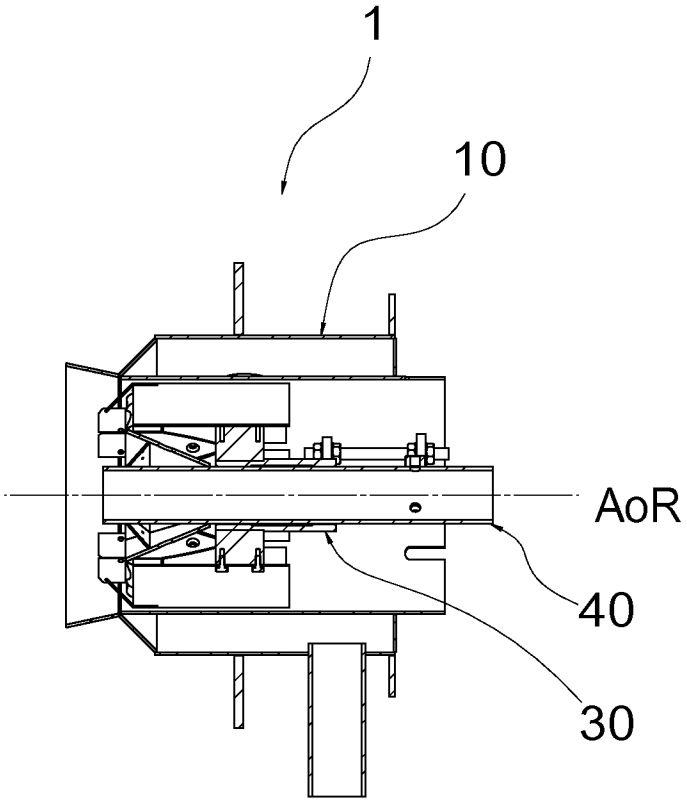
FIG. 4 is a section view of the burner head in FIG. 3, taken alone section line B-B.
Figure 3:
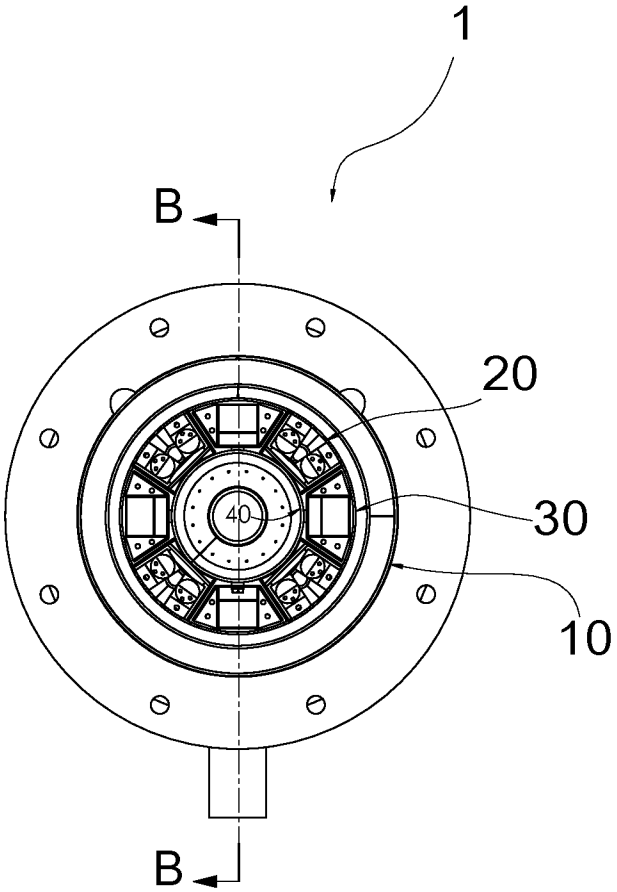
FIG. 3 is a front view of the burner head.

FIG. 3 is a front view of the burner head 1. FIG. 4 is a section view of the burner head in FIG. 3, taken along section B-B. The burner head 1 comprises a gas manifold 10, four aerodynamic blocks 20, an air control mechanism 30, and a center bluff body 40.

Figure 6:
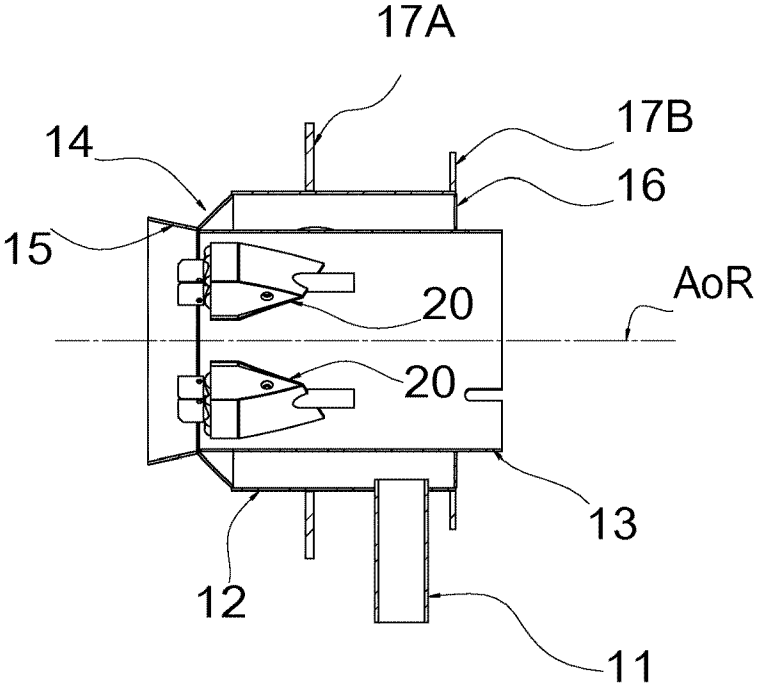
FIG. 6 is a sectional view of the burner head in FIG. 5 taken along line C-C.
Figure 5:
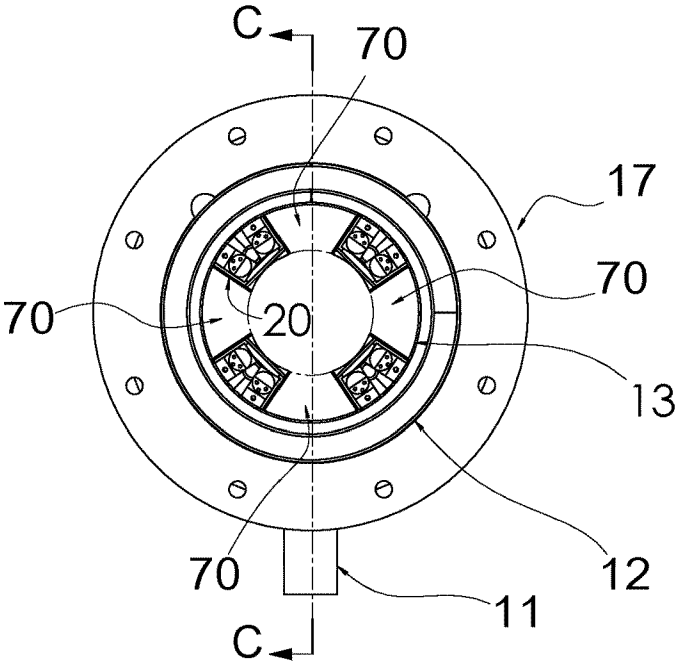
FIG. 5 is a front view of the burner head in FIG. 3, with some parts removed for clarity.

FIG. 5 is a front view of the burner head 1 in FIG. 3 with some parts removed for clarity, showing the gas manifold 10 and the aerodynamic blocks 20. FIG. 6 is a sectional view of the apparatus in FIG. 5 taken along lines B-B.

Figure 8:
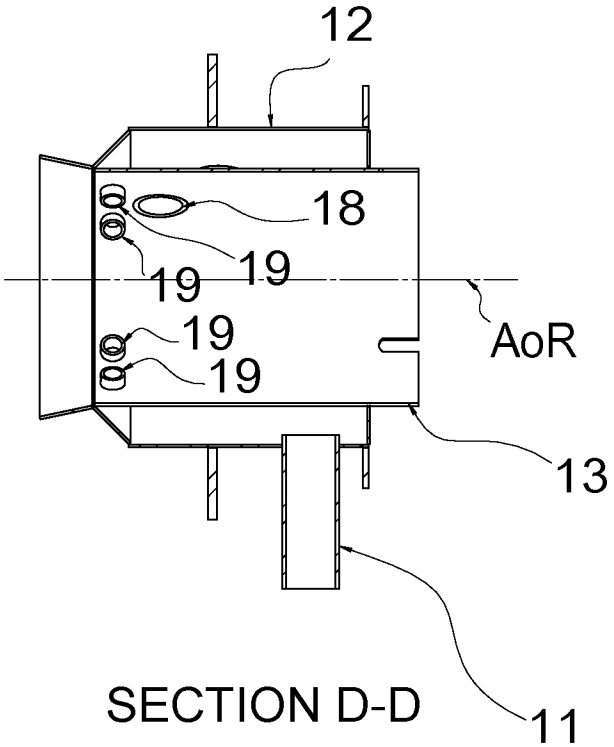
FIG. 8 is a sectional view of the burner head in FIG. 7 taken along line D-D.
Figure 7:
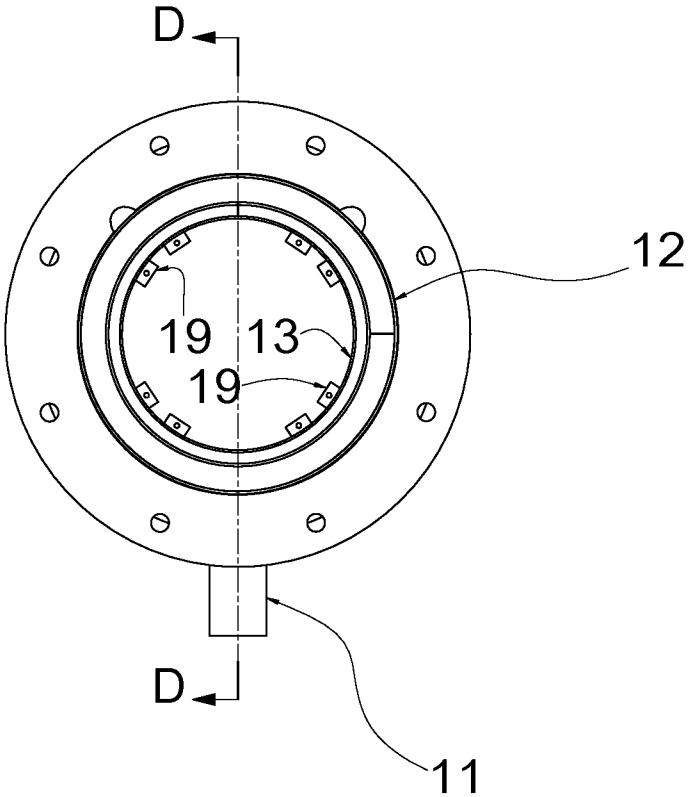
FIG. 7 is a front view of the burner head in FIG. 5, with some parts removed for clarity.

FIG. 7 is the same apparatus in FIG. 5 but with the aerodynamic blocks removed. FIG. 8 is the section view of the same apparatus in FIG. 7 taken along section C-C to show an access port 18 and fuel gas outlet ports 19.

Referring to FIGS. 3 through 8, the gas manifold 10 comprises a fuel gas inlet pipe 11, an outer tube 12, a blast tube 13, a cone 14, and an end cover 16. The blast tube 13 is substantially cylindrical with as axis of rotation AoR. The burner head 1 also include a diverging cone 15, a flange 17A that affixes the burner to the front of a boiler, and a flange 17B that affixes the burner to the air duct 105. The blast tube 13 is preferably in a substantially cylindrical shape, due to its relationship with components 20, 30 and 40. The outer tube 12, along with the blast tube 13, the cone 14 and end plate 16, forms an annular-shape gas manifold for the fuel gas. In the particular embodiment in FIG. 1 through 8, the outer tube 12 takes the shape of a cylinder; however, it could have taken other shapes such as rectangular or square in its cross section, and still functions as the outer wall of the gas manifold as well. Changing the external shape of the gas manifold to rectangular or square does not create a new invention outside the scope of the current invention. Similarly, the cone 14 could have taken the shape of a flat plate like the end plate 16, and still functions just as well as a part of the gas manifold.

Referring to FIG. 8, a fuel gas enters the gas manifold 10 through inlet pipe 11, and exits the gas manifold through eight outlet ports 19, which are evenly distributed in four groups of two on the blast tube 13. Each group of two ports 19 is housed in an aerodynamic block 20. Access port 18 is an opening on the blast tube 13 allowing for human observation through sight port 51, but it can similarly be used for the flame scanner 52. The outlet ports 19 take the form of tube segments welded to openings on the blast tube 13, with set screw ports 19A to allow easy attachment and detachment of gas injection spuds 60. The outlet ports 19 are pointing inwardly and radially toward the center axis of the blast tube 13.

Figure 10:
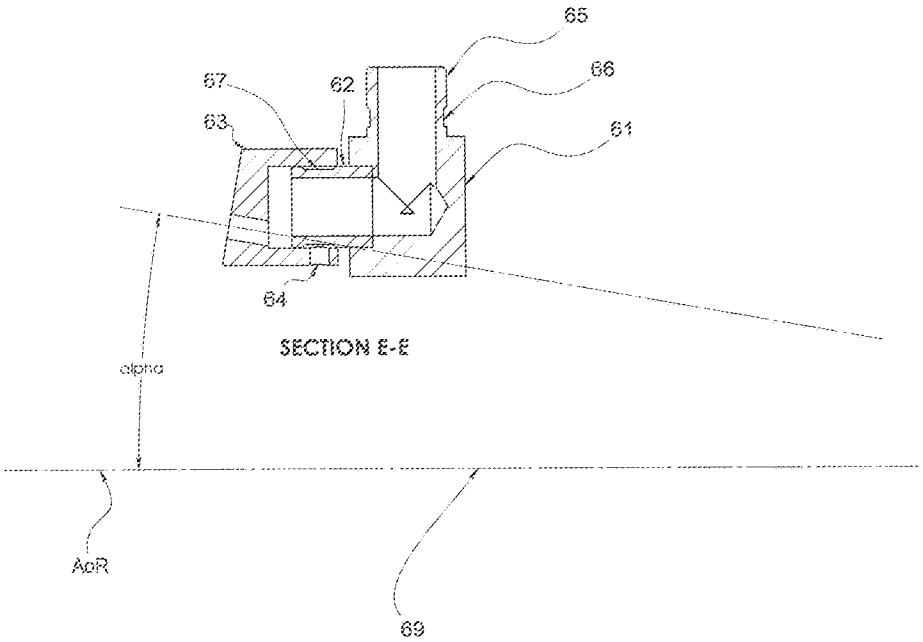
FIG. 10 shows a section view of the gas injection spud in FIG. 9, taken along line E-E.
Figure 9:
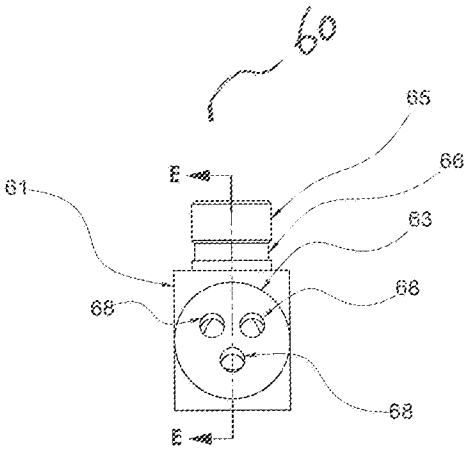
FIG. 9 shows a front view of a gas injection spud 60.

FIG. 9 shows a front view of gas injection spud 60. FIG. 10 shows a section view of the gas spud 60, taken along section E-E. The gas injection spud 60 consists of three parts, parts 61, 62 and 63. Part 61 has a male end 65 that goes into outlet port 19, a grove 66 for receiving a set screw in port 19A, and a female end that is 90 degree from the male end 65. Part 62 is a cylindrical tube with a grove 67 to receive a set screw in port 64. Part 62 is welded to part 61. Part 63 is a nozzle with a three gas ports 68, a female end and a screw port 64. The gas injection spud 60 can be attached and detached from one of the eight ports 19. By loosening the set screw through the port 19A, the spud 60 can also be rotated around the axis of part 61 to adjust its orientation. Similarly, by loosening the set screw through port 64, part 63 can be rotated around the axis of part 62.

The gas injection spud 60 allows fuel gas to exit from one of the eight ports 19 into the part 61, making a 90 degree turn from the radial and inward direction to the axial direction of the blast tube 13, and exit into the combustion air stream through injection ports 68. The injection ports 68 are generally pointing in the direction of the axis of the blast tube 13, flowing in substantially the same direction of the combustion air, but it can incorporate a small angle alpha between the direction of fuel gas injection and the axis of the blast tube 13. The small angle can allow the fuel gas to point slightly inward toward the center axis of the blast tube 13, or outward away from the center axis of the blast tube 13, or in any direction that may be advantageous to the shape of the flame and the emission performance of the burner. The number and size of ports 68 are dependents on the flow rate of the fuel gas and the gas pressure available. The fuel gas jets from ports 68 are located in the wake zone of the aerodynamic blocks 20. It is believed that these fuel gas jets entrain a significant amount of internal flue gas before they are mixed with the combustion air stream (which may contain external flue gas), resulting in low NOx and even ultra low NOx emissions.

Figure 11:
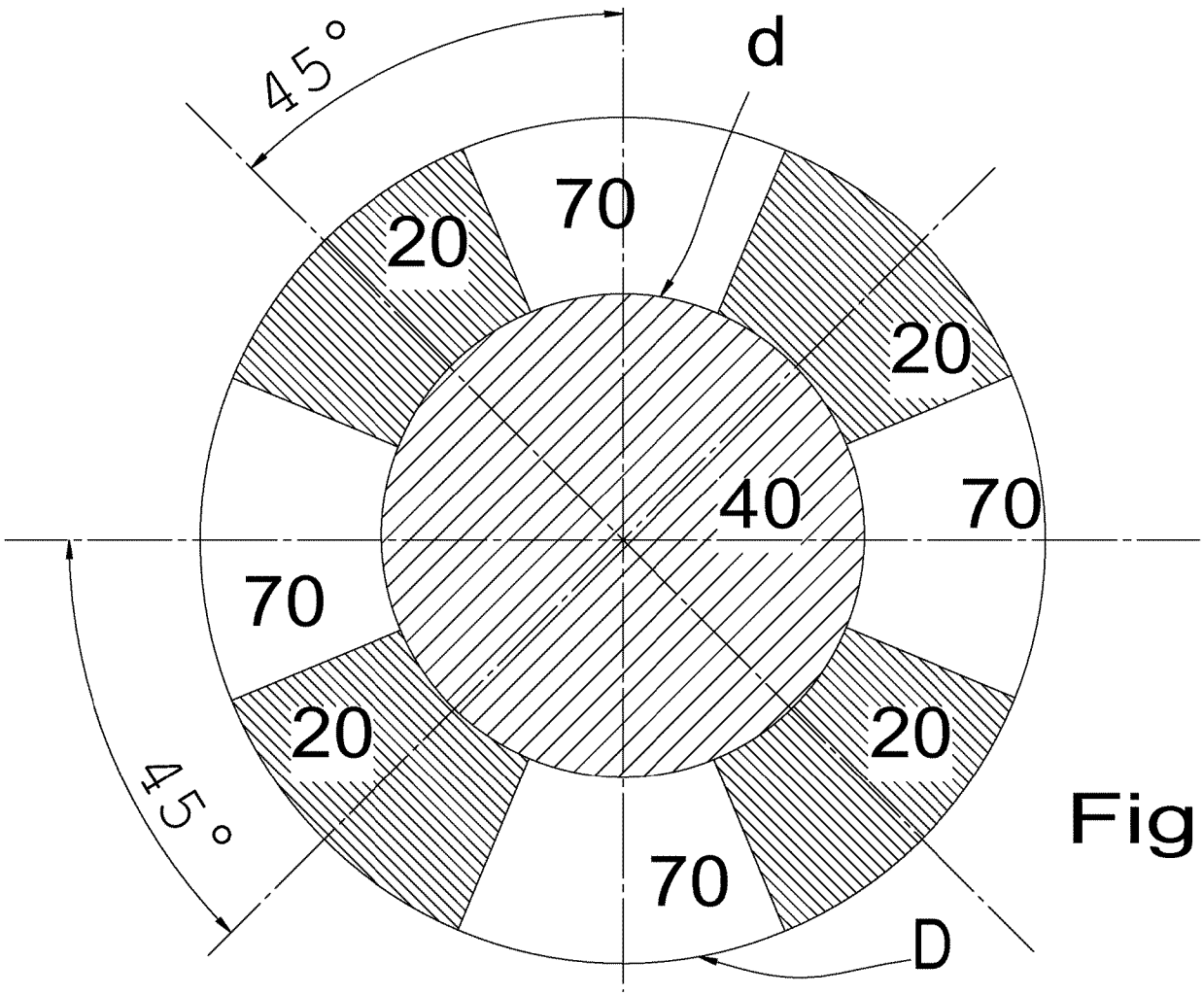
FIG. 11 shows a schematic illustration of the geometric relationship among different parts of the burner head in FIG. 3.
Figure 12A:
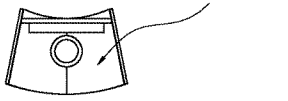
FIG. 12A shows a front view of the aerodynamic block 20.
Figure 12B:
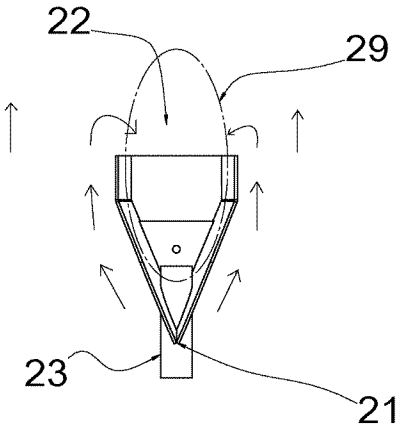
FIG. 12B shows a side view of the aerodynamic block 20.
Figure 12C:
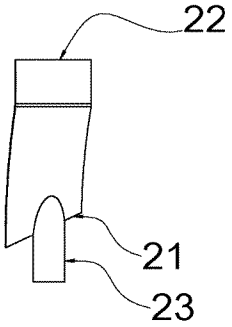
FIG. 12C shows another side view of the aerodynamic block 20.
Figure 12D:
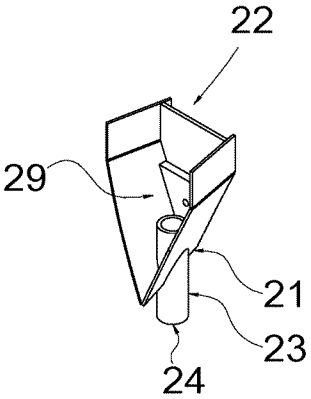
FIG. 12D shows a perspective view of the aerodynamic block 20.

FIG. 11 shows a schematic illustration of the relationship among different parts of the burner head. The inside diameter of the blast tube 13 is represented by an uppercase letter D. The outside diameter of the largest part of the cone 42 of the bluff body 40 is represented by a lowercase letter d. The shaded area in the center, marked with numeral 40, is the projected area taken by the center bluff body 40. The center bluff body represents 20-42% (preferably around 33%) of the cross sectional area inside the blast tube 13. In other words, the ratio d/D should be in the range of 0.45 to 0.65. The four shaded areas marked with numeral 20 are the projected areas taken by the four aerodynamic blocks 20. These areas together take up roughly another 20-40% (preferably around 33%) of the cross section area inside the blast tube 13. The spaces marked with numeral 70 are passages channels formed between the center bluff body 40 and the blast tube 13, and between the four aerodynamic blocks 20. These passage channels 70 allow combustion air to pass through the burner head. An air control mechanism 30 is used to control how the combustion air passes through these passage channels 70. Each passage channel 70 allows an air control module 33 to move back and forth in the axial direction of the blast tube 13. Both the aerodynamic blocks 20 and the center bluff body 40 are all considered bluff bodies in the combustion community. It can be seen that the burner head design of the current invention uses a large portion of the cross section area of the blast tube as bluff bodies; it uses a relatively small portion of the cross section area of the blast tube for the flow of the combustion air. The bluff bodies act to create recirculation zones in the wake zones downstream of these bluff bodies, allowing an extremely stable flame to establish in the wake zones, and allowing internal flue gas recirculation (IFGR) to help reduce NOx. Due to the internal FGR that is inherent to the geometries of the burner head 1, the burner head of the current invention is able to achieve low NOx emissions without external FGR, and ultra low NOx emissions with a reduced amount of external FGR. For example, the burner is able to achieve 25-40 ppm NOx emissions without the use of external FGR. With up to 25% external FGR, the burner is able to achieve NOx emissions as low as 3 ppm, dry volume based, corrected to 3% oxygen in the flue gas. The burner also enjoys a 10:1 or higher turndown for gas firing. It is capable of 8:1 turndown for oil firing. The burner can be operated with low excess air levels, which increases the thermal efficiency of the burner by minimizing the heat loss carried away by the exhaust gas, which is typically at a temperature higher than the ambient air.

FIG. 12 shows four views of the aerodynamic block 20. The aerodynamic block 20 comprises two oblique walls 25 joined at a leading end 21, two vertical walls 26 forming and an open trailing end 22, a triangular wall 27 and a removable wall 28. The triangular wall 27 is welded to the oblique walls 25. The removable wall 28 is attached to the triangular wall 27 by a set screw. Since the aerodynamic block 20 is attached to the inside of the blast tube 13, a void space is formed inside the walls 25 and 26, the walls 27 and 28, and the blast tube 13. This void space, together with the space downstream of the trailing end 22, is referred to as a wake zone 29. The wake zone 29 is characterized by relatively low flow velocity, since the approaching combustion air stream is diverted by the walls 25, 26 and 28 of the aerodynamic block. The wake zone 29 provides space for two gas injection spuds 60. The leading end 21 is narrow and substantially closed, with a tube 23 penetrating the leading end 21 to allow a small amount of combustion air to go into the aerodynamic block 20, if it is so desired. The tube 23 has an open end 24 facing the air flow approaching the leading end 21. The open end 24 can be threaded and capped off by a pipe cap (not shown). The open end 24 can be used as an access port for a gas fired pilot igniter (not shown), which is a common requirement in a burner. Referring to FIG. 12B, the combustion air approaches the leading end 21, flows around the aerodynamic block 20, and creates a wake zone 29 inside the aerodynamic block 20 and downstream of the trailing end 22. The average flow velocity is reduced in the wake zone, helping to stabilize the flame. The wake zone is also believed to help the formation of internal flue gas recirculation (IFGR). When fuel gas is injected through ports 68 of spud 60, the fuel gas entrains the internal flue gas before it mixes with the combustion air, which helps reduce the peak flame temperature and thermal NOx.

Figure 14:
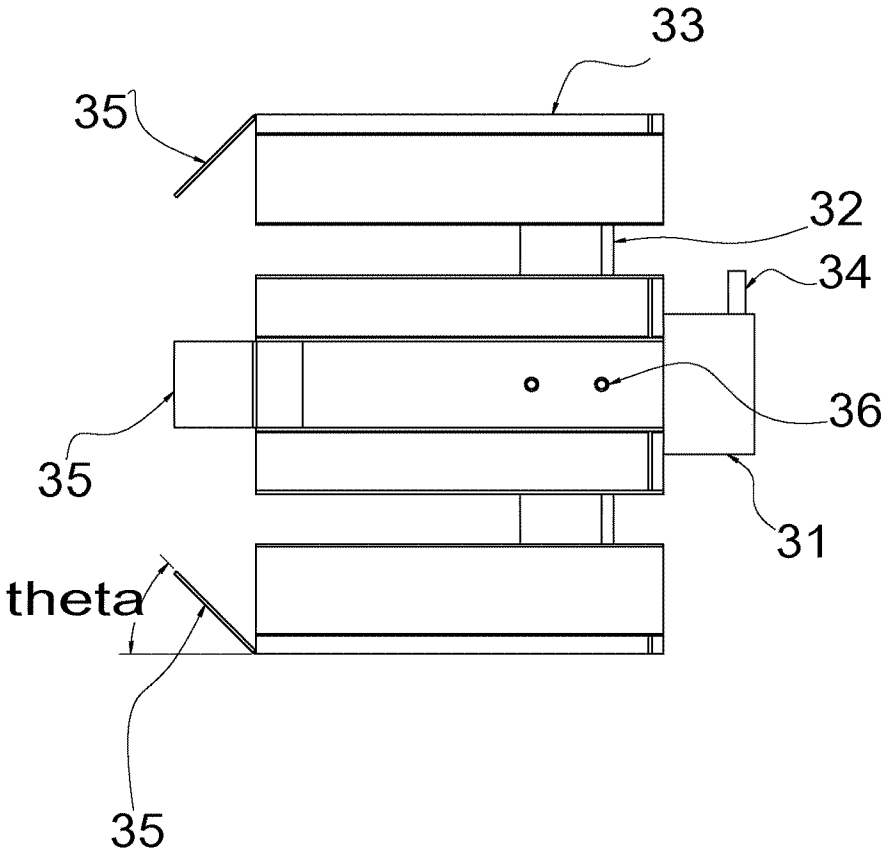
FIG. 14 is a side view of the air control mechanism 30.
Figure 13:
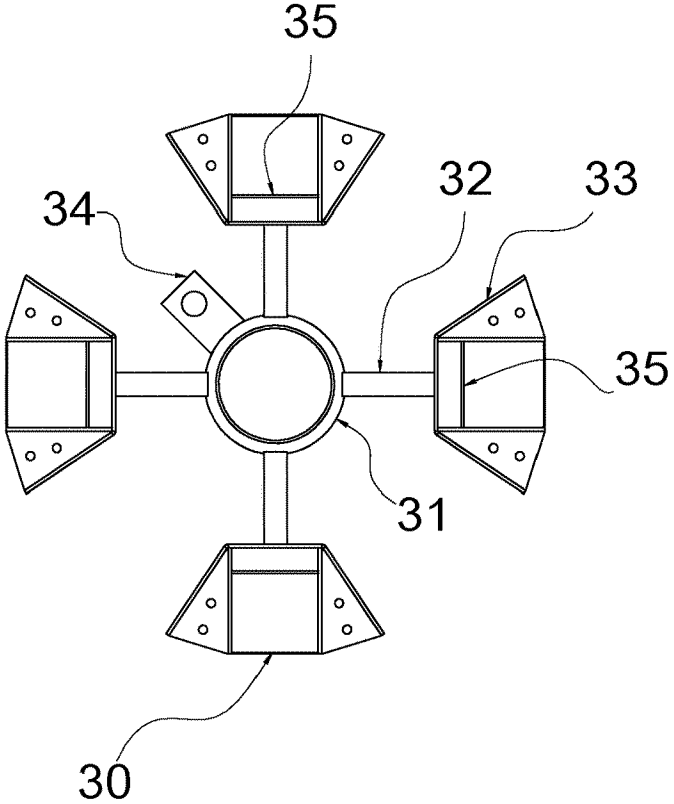
FIG. 13 is a rear view of the air control mechanism 30.

FIG. 13 shows the structure of the air control mechanism 30, which comprises a center hub 31, four arms 32, four air control modules 33, and a positioning bracket 34. FIG. 14 shows a side view of the same air control mechanism 30 shown in FIG. 13. Each arm 32 connects an air control module 33 to the center hub 31 so that when the center hub moves forward or backward in the axial direction of the blast tube 13, all four air control modules 33 move with the center hub in the same direction. Each arm 32 is welded to the center hub 31, and is connected to an air control module 33 using two fasteners through two ports 36. The center hub has the general shape of a pipe section, with its inner diameter machined smoothly to allow the tube 41 of the center bluff body 40 to go through. The positioning bracket can be connected to a corresponding bracket 44 on the center bluff body 40 through a rod.

Figure 15A:
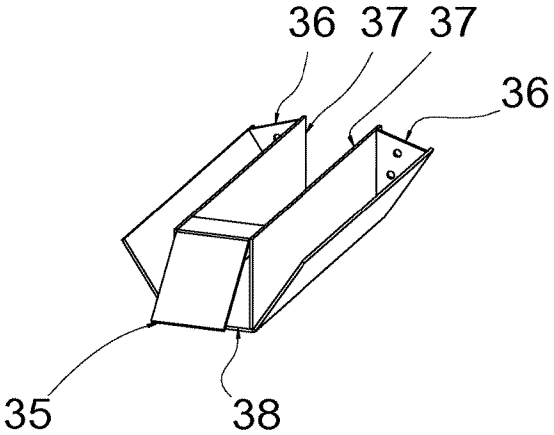
FIG. 15A shows a perspective view of the air control module 33.
Figure 15C:
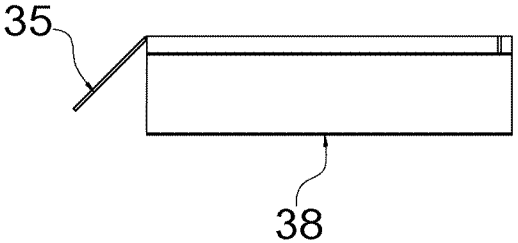
FIG. 15C shows a side view of the air control module 33.
Figure 15B:
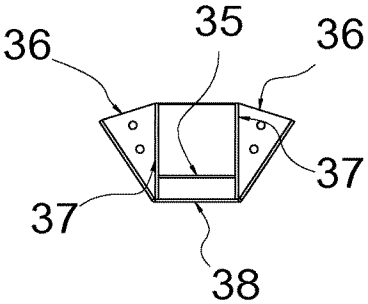
FIG. 15B shows a front view of the air control module 33.

FIG. 15 shows three views of the air control module 33, which comprises the deflector 35, the outer wall 38, two inner walls 37, and two decelerators 36. In the particular embodiment shown in FIG. 15, the two inner walls 37 are substantially parallel to each other, forming a passage channel with a rectangular cross section for the combustion air. The combustion air flows in this passage channel in parallel to the axis of blast tube 13, and is directed by the deflector 35 inward toward the center of the axis of the blast tube 13.

Figure 17:
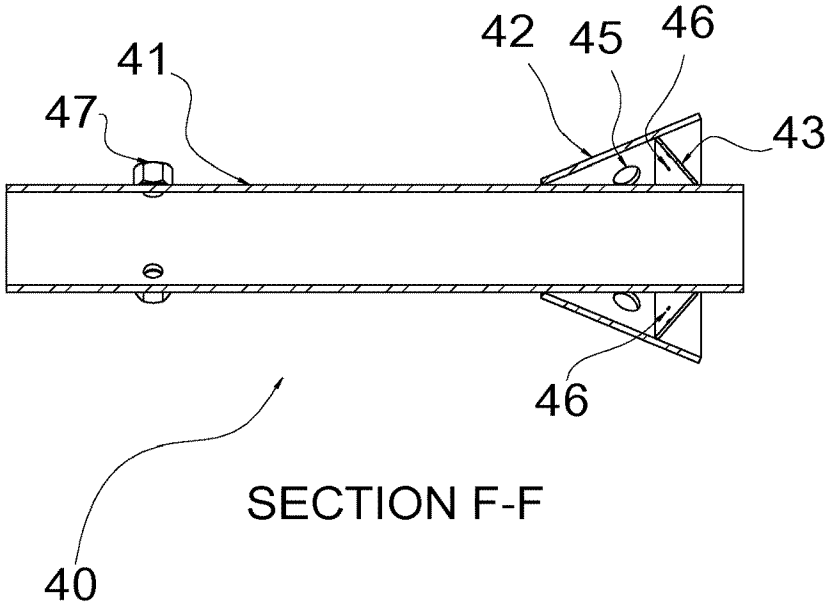
FIG. 17 is a section view of the center bluff body 40 in FIG. 16, taken along line F-F.
Figure 16:
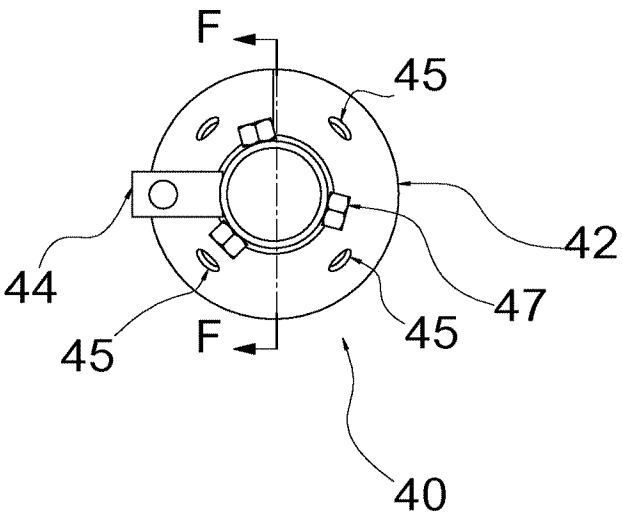
FIG. 16 is a rear view of the center bluff body 40.

FIG. 16 shows the rear view of the center bluff body 40. FIG. 17 are a section view of the same apparatus in FIG. 16. The enter bluff body 40 comprises a tube 41, a diverging cone 42, a cover cone 43, a positioning bracket 44. The diverging cone 42 has an outside diameter that is represented with a lower case letter d. The diverging cone 42 has four holes 45 allowing small amount of air to go through ports 46 on the cover cone 43 in order to cool the cover cone 43, to avoid mechanical failure due to overheat from the flame. Three nuts 47 are used with three bolts 48 (two bolts 48 shown in FIG. 2) for centering of the tube 41 relatively to the blast tube 13. The cover cone 43 tends to be subject to high temperatures due to the recirculation pattern formed in the stream of the cone 42. In an alternative embodiment, the cover cone 43 could take the shape of a flat plate. In yet another embodiment, the cover cone 43 can be eliminated.

The tube 41 serves multiple purposes. First it provides a conduit for the insertion of an oil gun, where fuel oil or other liquid fuels can be injected for combustion. In many places, it is advantageous to be able to switch from a gaseous fuel to a standby liquid fuel when the supply of the gaseous fuel is in short supply or is interrupted. Second, it serves as a guide for the center hub 31. The axis of the tube 41 substantially coincides with the axis of the blast tube 13. When the center hub 31 slides forward or backward along the axis of the tube 41, the entire air control mechanism 30 moves accordingly. This movement changes the locations of the air deflectors 35 relative to the cone 42 of the center bluff body 40 and the gas injection spuds 60. This axial movement changes the flow pattern of the combustion air, which affects the flame shape. The axial movement of the air control mechanism 30 can be used to shape the flame from a bushy short flame to a narrow long flame, and vice versa.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Obviously many modifications and variations are possible in view of the above teachings. The embodiments were chosen and described in order to best explain the principles of the invention and its practical applications, the thereby enable others skilled in the art to best utilize the invention and various embodiments with various modifications as are suited to the particular use contemplated. It is intended that the scope of the invention be defined by the following claims and their equivalents.

What is claimed is:

1. An apparatus for burning of a gaseous fuel, said apparatus comprising:

a gas manifold (10) comprising an inlet pipe (11), a blast tube (13) and an outer wall (12), wherein said blast tube is substantially cylindrical with an inside diameter (D) and an axis of rotation (AoR);

a center bluff body (40) comprising a center tube (41) with two open ends and a through port in the center to allow insertion of a spray gun for a liquid fuel, and a diverging cone (42), said diverging cone having a larger end with an outside diameter (d) such that the ratio (d/D) is in a range of 0.45 to 0.65;

four aerodynamic blocks (20) circumferentially distributed in a substantially annular space between said blast tube and said diverging cone of said center bluff body (40), creating passage channels (70) for combustion air between said aerodynamic blocks, said aerodynamic blocks are affixed to an inside of said blast tube, each of said aerodynamic blocks comprising a smaller and substantially closed leading end (21), and a larger and open trailing end (22), forming a wake zone (29) inside and downstream of said aerodynamic block;

two injector nozzles (60) located inside said wake zone of each of said aerodynamic block, each of said nozzles is fluidically communicated with said gas manifold and comprises a plurality of injection ports (68);

an air control mechanism (30) moveable in both directions along said axis of rotation, comprising a center hub (31) fitting concentrically around said center tube (41) and a plurality of air control modules (33) affixed to said center hub, said air control modules fitting through said passage channels (70), wherein each air control module comprising a rectangular air duct disposed between two triangular air ducts, and an air deflector (35) located at an outer edge of said rectangular air duct deflecting air radially inward toward said axis of rotation, said deflector forming an angle theta equal to or greater than 30 degrees from said axis of rotation (AoR), wherein a perforated plate is positioned across an inlet of each triangular air duct.

2. The apparatus as described in claim 1 further comprises a blower for the supply of combustion air and for induction of recirculated flue gas, and a louver box affixed to the inlet of said blower; said louver box includes an inlet pipe for recirculated flue gas.

3. The apparatus as described in claim 1 wherein said angle theta is 45 degrees.

4. The apparatus as described in claim 1 wherein said diverging cone has a larger end with an outside diameter (d) such that (d/D) is 0.58.

5. The apparatus as described in claim 1 wherein the projected cross section area of the aerodynamic blocks is in a range of 0.25-0.40 of the total cross section area within the inside diameter (D) of the blast tube (13).

6. The apparatus as described in claim 5 wherein the projected cross section area of the aerodynamic blocks is in a range of 0.33 of the total cross section area within the inside diameter (D) of the blast tube (13).

7. The apparatus as described in claim 1 wherein said blower is driven by an electric motor, said motor is equipped with a variable frequency drive.

* * * * *